United States Patent [19]

Andersson

[11] 4,165,946

[45] Aug. 28, 1979

[54] METHOD OF SECURING A ROCK BOLT

[75] Inventor: Gustav S. Andersson, Stockholm, Sweden

[73] Assignee: Aktiebolaget Atomenergi, Stockholm, Sweden

[21] Appl. No.: 824,329

[22] Filed: Aug. 12, 1977

[30] Foreign Application Priority Data

Aug. 12, 1976 [SE] Sweden ..... 7609058

[51] Int. Cl.[2] ..... E21D 21/00

[52] U.S. Cl. ..... 405/259; 227/9

[58] Field of Search ..... 61/45 B; 85/65; 227/9, 227/10; 405/259

[56] References Cited

U.S. PATENT DOCUMENTS

| | | | |
|---|---|---|---|
| 2,573,880 | 11/1951 | Temple | 85/65 |
| 2,618,192 | 11/1952 | Temple | 61/45 B X |
| 2,813,449 | 11/1957 | Barrett | 85/65 |
| 3,311,012 | 3/1967 | Williams | 61/45 B X |

*Primary Examiner*—Jacob Shapiro

*Attorney, Agent, or Firm*—Burns, Doane, Swecker & Mathis

[57] ABSTRACT

When securing a rock bolt in a drilled hole in the rock the bolt having a conical end, is inserted to the desired depth in the hole. A gun, charged with a sleeve, is applied on the outer end of the rock bolt, and the bolt is centered in the gun barrel. The sleeve is shot into the hole at a high speed to be wedged in the gap between the conical end of the bolt and the wall of the hole.

6 Claims, 1 Drawing Figure

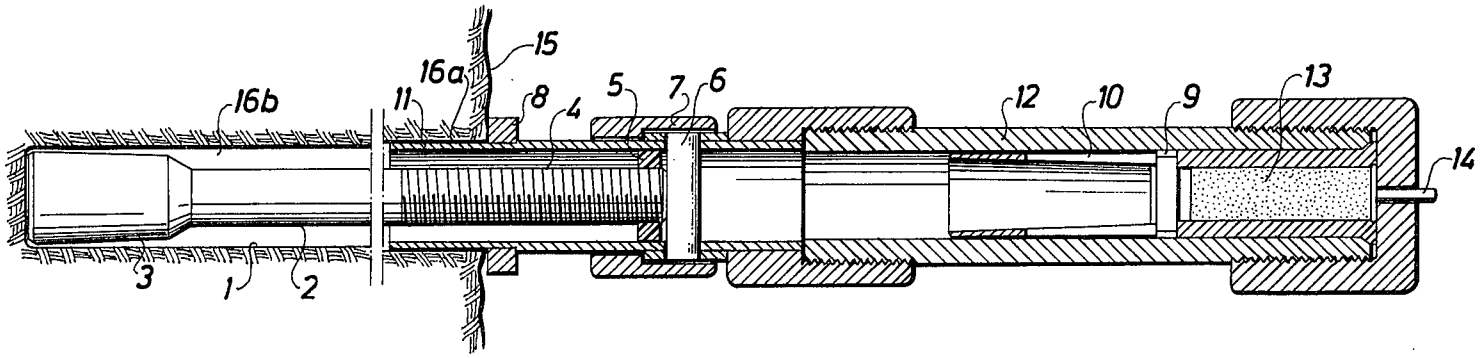
14
13
9
10
12
6
7
5
4
8
15
16a
11
16b
2
1
3

METHOD OF SECURING A ROCK BOLT

The invention relates to a method of securing a rock bolt in which the bolt, having a conical end, is inserted in a hole drilled in the rock face, after which a sleeve is inserted into the hole and wedged in the gap between the conical end of the bolt and the wall of the hole. The object of the rock bolt is generally to reinforce the rock, but it may also act as suspension bolt for pipe conduits, for example.

When blasting tunnels the rock may have to be reinforced. Long holes are drilled into the rock and rock bolts secured at the very end, the projecting part then being tightened by means of nuts. In order to prevent collapse, this reinforcement must be performed within a few hours after blasting.

It is vital that the rock bolt is firmly anchored at its innermost end. This firmness cannot be checked with existing types of rock bolts as they must generally be grouted into the rock. The strength of the grouting can of course be tested by pulling on the bolt but this is not a reliable test since the bolt may remain in position even if the grouting has only been successful around a part of the bolt, such as near the outer end.

When securing a rock bolt of the type described above, the sleeve is wedged by repeated hammering, a tube surrounding the bolt having been inserted in the hole and the sleeve hammered in between the conical end of the bolt and the wall of the hole by means of the tube, using a compressed-air gun, for example.

According to the invention the sleeve is instead secured by shooting it into the hole at high speed by means of compressed air or an explosive charge. It has been found that the initial anchoring of the sleeve is then better than if it is secured by means of repeated hammering. Furthermore, it has been found that the rock around the sleeve does not crumble, which may easily happen upon conventional hammering. The sleeve should preferably be given a speed of at least 50 m/sec. It should also be relatively heavy in order to achieve high kinetic energy.

The invention will be explained with reference to the drawing showing a drill hole with a rock bolt and a gun barrel ready to shoot a sleeve.

A hole is drilled in a rock wall 15, the hole 16 having an outer section 16*a* with somewhat greater diameter than the inner section 16*b*. A bolt 2 is then inserted in the hole 2. In the event of the hole having been drilled too deep an object of suitable length, of wood for instance, is inserted before the bolt, to the bottom of the hole. The end of the bolt which is to be inserted into the rock increases conically in thickness towards its end 3. The other end of the bolt is provided with a threaded section 4 onto which is secured a ring 5 of nylon, for instance.

The sleeve 10 to be inserted is applied in the outer part 12 of a gun barrel 11, 12, which also contains an explosive charge 13 and an igniter 14. The sleeve 10 is provided with longitudinal slits, and it has a wall 9 sealing against the rear end of the sleeve. The gun barrel 11 is provided with a cross bar 6, of wood, for instance, against which the end 4 of the bolt can rest. The bar is secured with a socket 7. The front end 11 of the gun barrel is inserted into the hole 16*a* in the rock and its support ring 8 moved forward to make contact with the rock wall 15. The gun barrel is kept in this position during shooting by means of a support, not shown. The powder gases press on the wall 9, loosely connected to the sleeve 10, and the rear peripheral part of the sleeve, and force the sleeve to increase speed. The sleeve 10 cuts through the bar 6, ring 5 and is finally wedged between the cone 3 and the wall of the hole. Expansion of the sleeve is facilitated by the longitudinal slits. The powder gases partially escape through the gap between the gun barrel and the rock face. Testing has shown that no hole is required in the side of the gun barrel for the powder gases to escape. The deep hole in the rock can take up the gases without impermissible pressure increase.

In addition to centering the bolt in the gun barrel prior to shooting, the nylon ring 5 provides control after the shooting in that the residue of the nylon ring prevents the threaded end of the bolt from being deformed by hitting against the gun barrel.

When the gun barrel 11, 12 has been removed, concrete is preferably injected into the hole 16. The bolt can now be prestressed to the desired tension before the concrete solidifies by means of a nut and washer applied on the threaded end 4 of the bolt.

What is claimed is:

1. Method of securing a rock bolt in which the bolt, having a conical end, is inserted in a hole drilled in the rock face after which a sleeve is inserted into the hole and wedged in the gap between the conical end of the bolt and the wall of the hole, the sleeve being shot into the hole at high speed with the aid of compressed air or an explosive charge, the sleeve being inserted into the hole by means of a gun barrel applied around the outer end of the bolt, and the outer end of the bolt being centered in the gun barrel by means of a ring of soft material which is perforated upon shooting.

2. A method of securing a rock bolt in a rock face comprising the steps of:

drilling a hole having a bottom and a side wall in the rock face;

inserting a conical end of a rock bolt to the bottom of the hole so that a gap is defined between the conical end and the side wall; and shooting a sleeve into the hole and along the length of the rock bolt at high speed to wedge the sleeve in the gap.

3. The method of claim 2 wherein the shooting step is accomplished using compressed air.

4. The method of claim 2 wherein the shooting step is accomplished using an explosive charge.

5. Method according to claim 2, including moving the sleeve at a speed of at least 50 m/sec.

6. Method according to claim 2, including applying a material to reduce friction, such as polytetrafluoroethylene, to at least one of the conical end of the bolt and the inside of the sleeve.

* * * * *